US010302382B1

(12) United States Patent
Kistner et al.

(10) Patent No.: US 10,302,382 B1
(45) Date of Patent: May 28, 2019

(54) DEVICE FOR LOADING AMMUNITION INTO MAGAZINES

(71) Applicants: Kenneth J. Kistner, Midlothian, TX (US); Carolyn R. Kistner, Midlothian, TX (US)

(72) Inventors: Kenneth J. Kistner, Midlothian, TX (US); Carolyn R. Kistner, Midlothian, TX (US)

( * ) Notice: Subject to any disclaimer, the term of this patent is extended or adjusted under 35 U.S.C. 154(b) by 0 days.

(21) Appl. No.: 15/811,403

(22) Filed: Nov. 13, 2017

Related U.S. Application Data

(60) Provisional application No. 62/469,806, filed on Mar. 10, 2017, provisional application No. 62/420,361, filed on Nov. 10, 2016.

(51) Int. Cl.
*F41A 9/83* (2006.01)
*F41A 9/67* (2006.01)

(52) U.S. Cl.
CPC .. *F41A 9/83* (2013.01); *F41A 9/67* (2013.01)

(58) Field of Classification Search
CPC ..... F41A 9/82; F41A 9/83
USPC ..... 42/87–88; 89/33.5
See application file for complete search history.

(56) References Cited

U.S. PATENT DOCUMENTS 1,295,039 A * 2/1919 Johnson et al. ..... F41A 9/83 86/47
4,706,402 A * 11/1987 Csongor ..... F41A 9/84 42/87
4,719,715 A * 1/1988 Howard ..... F41A 9/83 42/87
5,129,173 A * 7/1992 Kuykendall ..... F41A 9/83 42/87
5,249,386 A * 10/1993 Switzer ..... F41A 9/83 42/87
2015/0316341 A1* 11/2015 Aguilar ..... F41A 9/83 42/87

FOREIGN PATENT DOCUMENTS

WO WO-2014082017 A1 * 5/2014 ..... F41A 9/83

* cited by examiner

*Primary Examiner* — John Cooper
(74) *Attorney, Agent, or Firm* — James E. Walton

(57) ABSTRACT

A system and method for quickly and safely inserting multiple rounds of ammunition into a magazine. The system is adjustable for various sizes of magazines and calibers of cartridges. Users depress a plunger that applies a force to the exposed cartridge in the magazine thereby compressing the spring inside the magazine and providing room for another round to be inserted into the magazine. The plunger is then released and the process can be repeated until the magazine is filled or the user is done.

14 Claims, 9 Drawing Sheets

DEVICE FOR LOADING AMMUNITION INTO MAGAZINES

CROSS-REFERENCE TO RELATED APPLICATIONS

This application claims the benefit of U.S. Provisional Application No. 62/420,361, filed 10 Nov. 2016, titled "Device for Loading Ammunition into Magazines," and of U.S. Provisional Application No. 62/469,806, filed 10 Mar. 2017, titled "Device for Loading Ammunition into Magazines," all of these applications are incorporated herein by reference for all purposes.

BACKGROUND

1. Field of the Invention

The present application relates in general to the field of speed loaders for ammunition magazines, more specifically, to a system and method of easily and quickly loading ammunition into magazines for weapons.

2. Description of Related Art

Magazines for the storage of ammunition in a gun utilizes a spring to apply pressure to the next round to be chambered. The force required by the spring increases as the capacity for the magazine is increased. Likewise the force to fill the magazine increases as each round is inserted into the magazine. Considerable force must be applied by the user to depress the loaded round while inserting the next round into the magazine. While there are many ways to load ammunition into magazines, well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
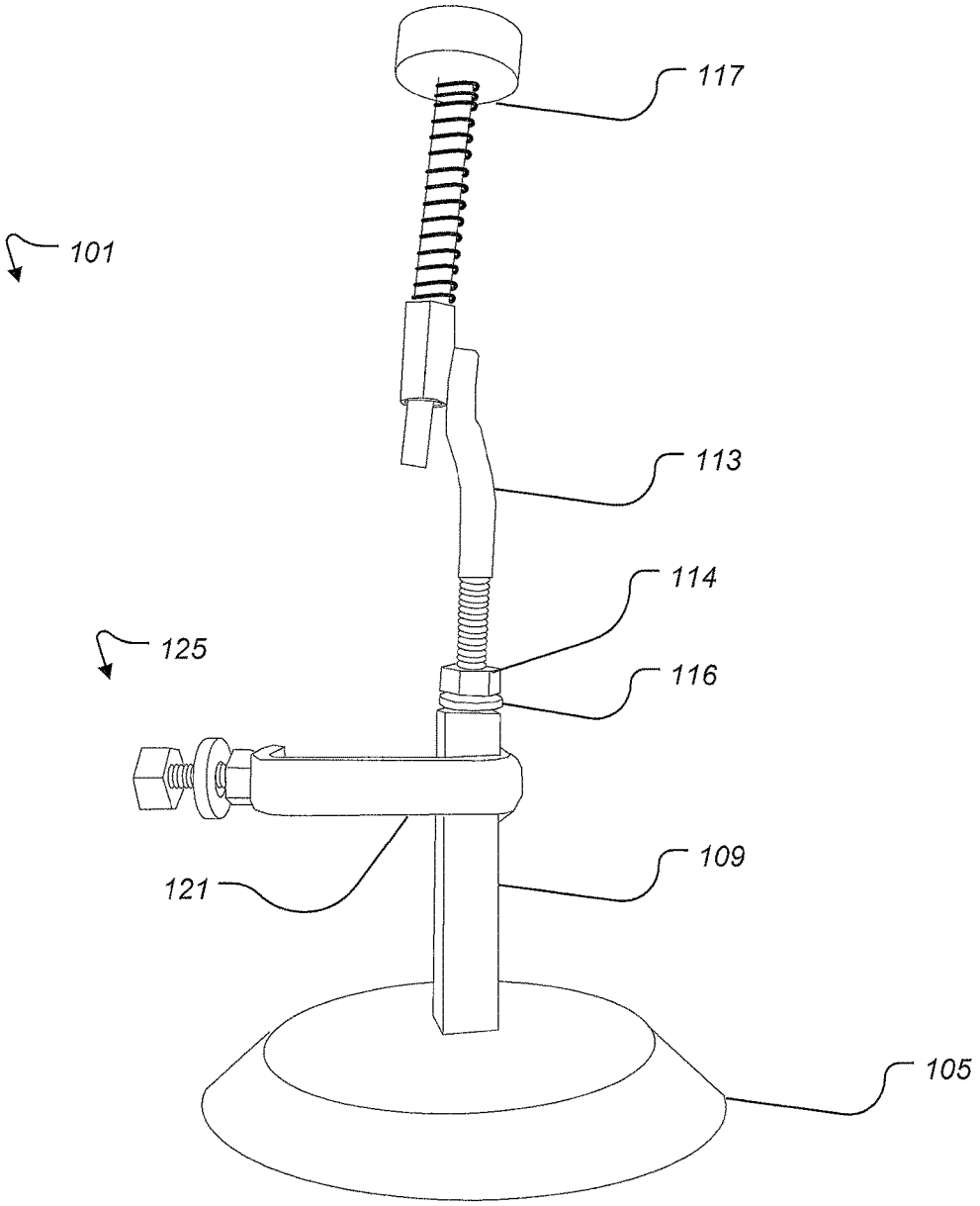
FIG. 1 is a side perspective view of a device for loading ammunition into a magazine according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of loading ammunition into magazines are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time consuming, but would nevertheless be a routine undertaking for those of ordinary skill in the art having the benefit of this disclosure.

An improved magazine loader retains the magazine without the user holding the magazine. An improved magazine loader reduces the force necessary to insert ammunition into the magazine. An improved magazine loader is adjustable to accommodate magazines of various heights and calibers. The improved EZE loader reduces the amount of time and stress associated with reloading ammunition into magazines or clips.

Figure 2:
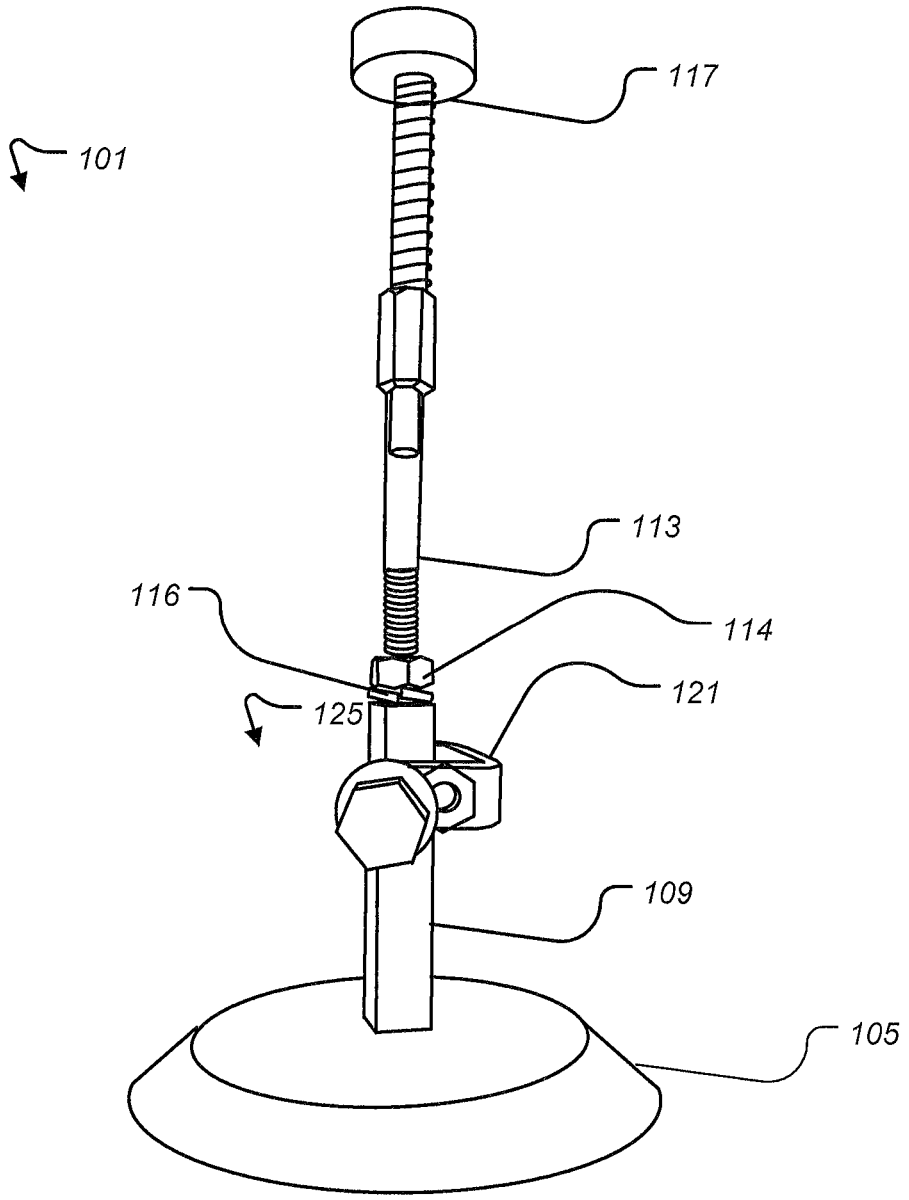
FIG. 2 is an end perspective view of a device for loading ammunition into a magazine according to the present application.

Referring now to FIG. 1, a side perspective view of a device for loading ammunition into a magazine according to the present application is illustrated. Referring now also to FIG. 2, an end perspective view of a device for loading ammunition into a magazine according to the present application is illustrated. Device 101 is comprised of a base 105, a first member 109, a second member 113, a plunger 117, an arm 121, and a retainment device 125. Base 105 is typically a raised circular platform configured to retain first member 109 though the center of the base. Alternatively, the base is a clamp configured to attach the device to a bench or tabletop. Typically the first member 109 is coupled to the base 105 by a fastener, a head of the fastener is hidden underneath the base. Alternatively the first member is integral with the base. In an alternative embodiment the base 105 further comprises an opening configured that the magazine can be located above and below the base, for example a magazine retaining forty rounds might be of such a length that the magazine goes through the base while the base is supported by a plurality of removable legs providing additional height to the device.

First member 109 is comprised of a threaded opening configured for retaining the second member 113. Second member 113 is comprised of a threaded end and a tubular end. A nut 114 and a lock washer 116 are utilized to allow the user to adjust a height of the plunger by moving the second member relative to the first member and tightening the nut down. Tubular end is configured for receiving the plunger 117. Second member is bent in such a way that a lower end of the plunger 117 is located between the retainment device 125 and the lower member 109. Since the second member 113 has a first end and a second end offset from the first end the plunger 117 is offset from the first member.

Plunger 117 is spring loaded such that the plunger returns to a starting position after the user has removed their hand from the plunger. Plunger has a bulbous head and a flat lower face, and is retained to the tubular end of the second member by an o-ring around a lower portion of the plunger. Arm 121 extends from first member 109 and is curved such that an opening is created between the retainment device 125 and the first member 109. Retainment device 125 is threadingly retained by the arm 121. Retainment device 125 is preferably a hex headed bolt with a plastic washer underneath the hex head. Retainment device 125 is adjusted by the user to apply force to a side of the magazine and keep the magazine in place while the plunger 117 applies force to the cartridges in the magazine.

Figure 3:
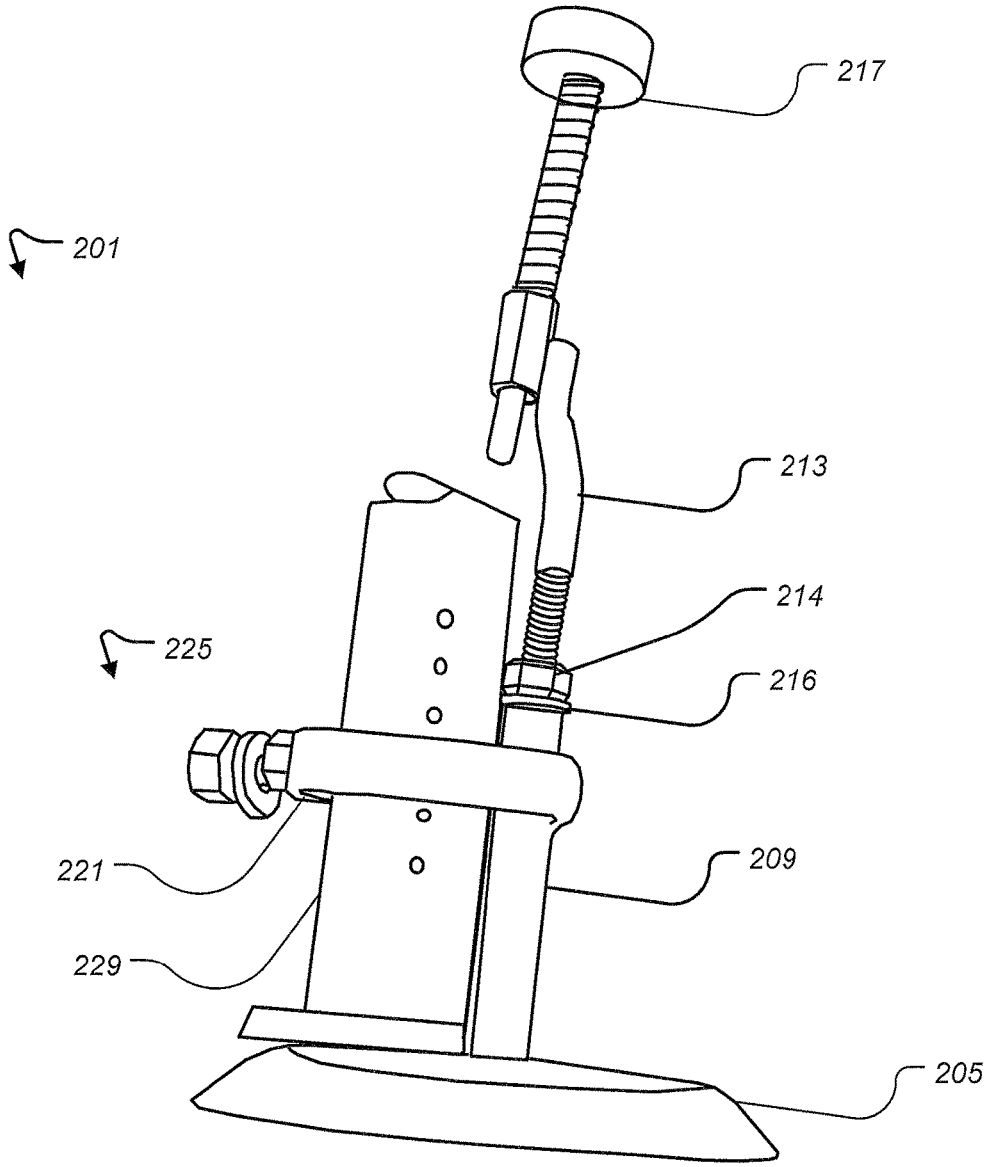
FIG. 3 is a side perspective view of a device for loading ammunition into a magazine holding a magazine according to the present application.
Figure 4:
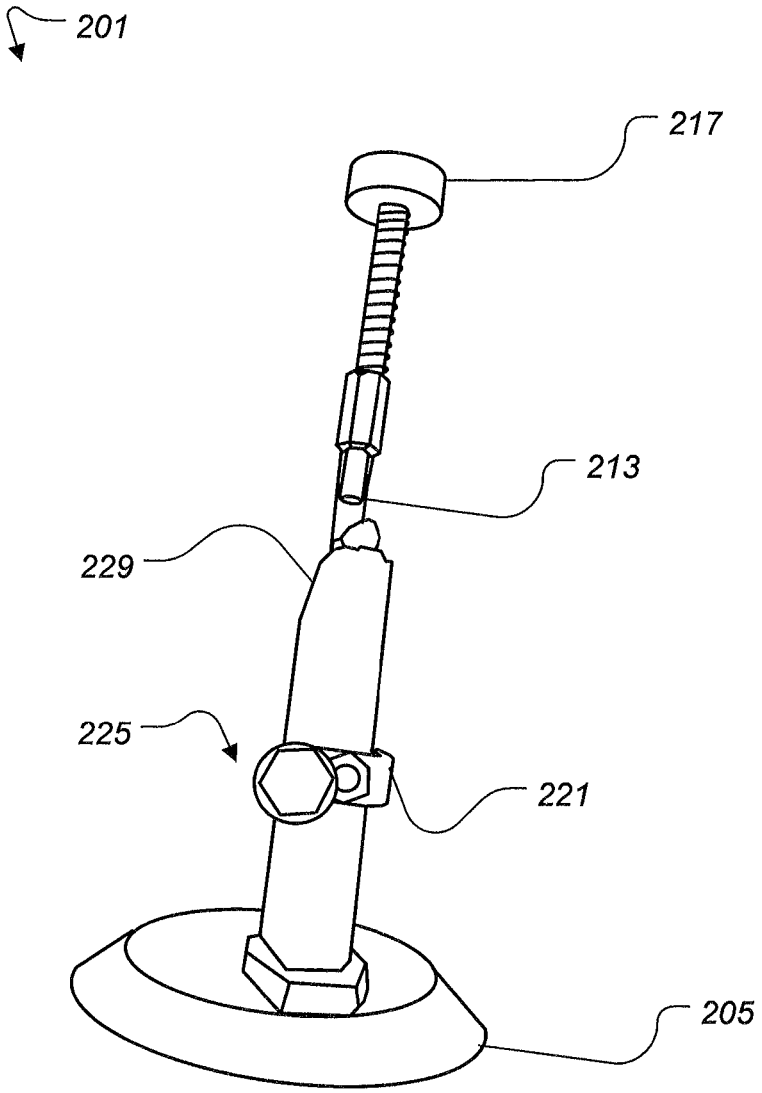
FIG. 4 is an end perspective view of a device for loading ammunition into a magazine holding a magazine according to the present application.

Referring now also to FIG. 3, a side perspective view of a device for loading ammunition into a magazine according to the present application is illustrated. Referring now also to FIG. 4, an end perspective view of a device for loading ammunition into a magazine according to the present application is illustrated. Device 201 is comprised of a base 205, a first member 209, a second member 213, a plunger 217, an arm 221, a retainment device 225, and a magazine 229. Base 205 is typically a raised circular platform configured to retain first member 209 though the center of the base. Typically the first member 209 is coupled to the base 205 by a fastener, a head of the fastener is hidden underneath the base. Alternatively the first member is integral with the base. In an alternative embodiment the base 205 further comprises an opening configured that the magazine can be located above and below the base, for example a magazine retaining forty rounds might be of such a length that the magazine goes through the base while the base is supported by a plurality of removable legs providing additional height to the device.

First member 209 is comprised of a threaded opening configured for retaining the second member 213. Second member 213 is comprised of a threaded end and a tubular end. A nut 214 and a lock washer 216 are utilized to allow the user to adjust a height of the plunger by moving the second member relative to the first member and tightening the nut down. Tubular end is configured for receiving the plunger 217. Second member is bent in such a way that a lower end of the plunger 217 is located between the retainment device 225 and the lower member 209.

Plunger 217 is spring loaded such that the plunger returns to a starting position after the user has removed their hand from the plunger. Plunger is retained to the tubular end of the second member by an o-ring around a lower portion of the plunger. Arm 221 extends from first member 209 and is curved such that an opening is created between the retainment device 225 and the first member 209. Retainment device 225 is threadingly retained by the arm 221. Retainment device 225 is preferably a hex headed bolt with a plastic washer underneath the hex head. Retainment device 225 is adjusted by the user to apply force to a side of the magazine and keep the magazine 225 in place while the plunger 217 applies force to the cartridges in the magazine.

Figure 5:
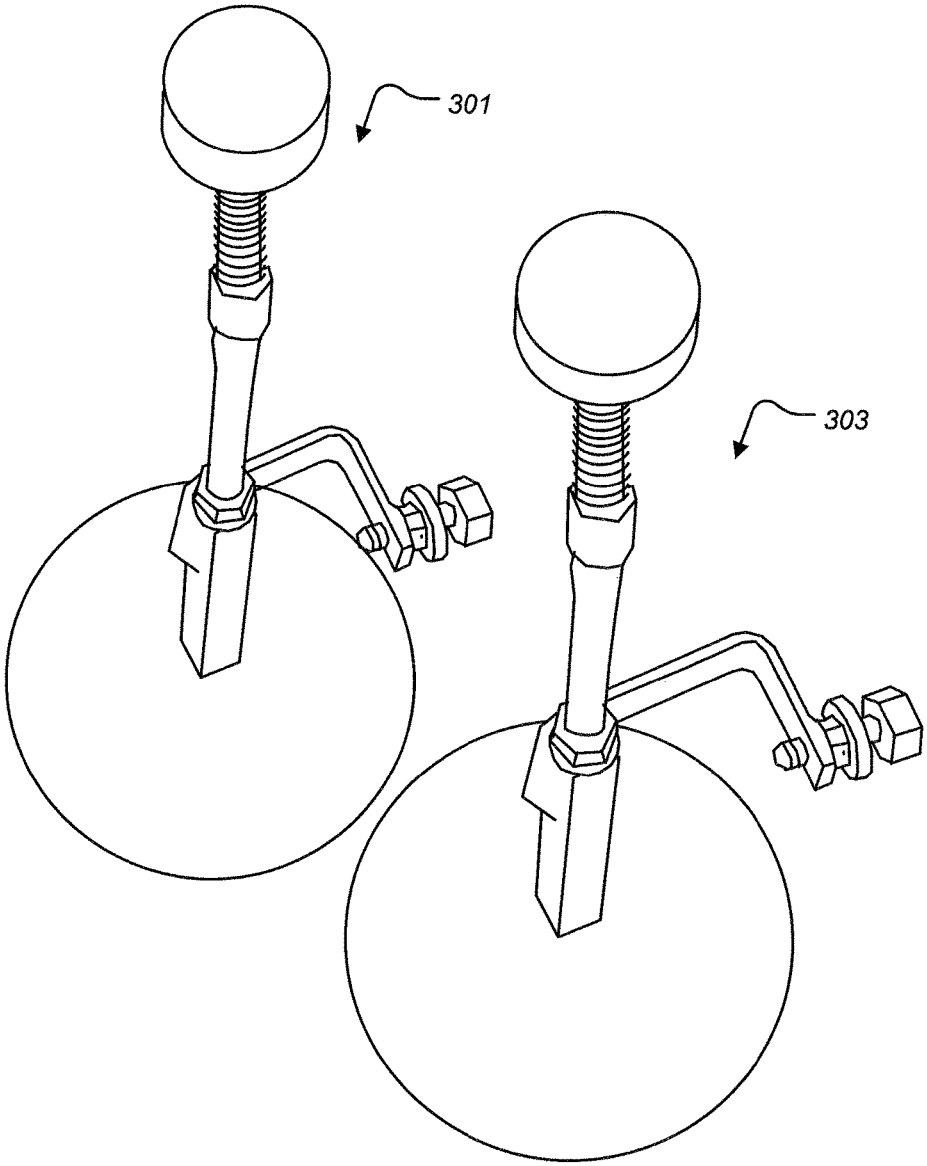
FIG. 5 is a top perspective view of a pair of devices for loading ammunition into a magazine according to the present application.

Referring now also to FIG. 5, a top perspective view of a pair of devices for loading ammunition into a magazine according to the present application is illustrated. First device 301 and second device 303 utilize arms of different shapes and sizes. A wide variety of magazines can be utilized with the device because of the height adjustment between the first member and the second member. Furthermore, the arm, in alternative embodiments, has a first and second part coupled together to provide the arm with an adjustable length and the ability to accommodate magazines of various calibers.

Figure 6:
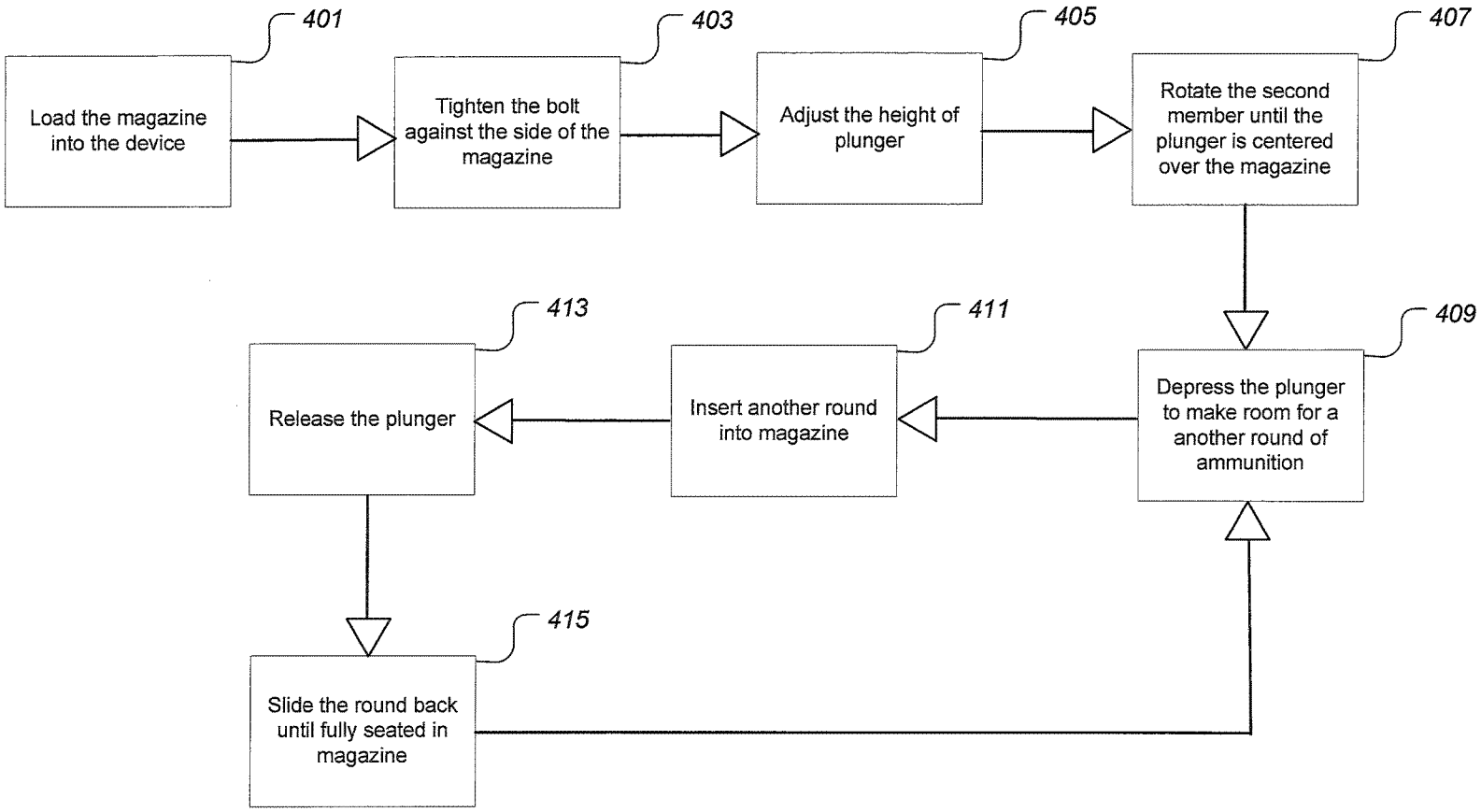
FIG. 6 is a schematic of a method for using a device for loading ammunition into a magazine according to the present application.

Referring now also to FIG. 6, a flow chart of a method for using a device for loading ammunition into a magazine according to the present application is illustrated. First, the user loads the magazine into the device 401. Second, the user tightens the retainment device or bolt against the side of the magazine to lock the magazine in place 403. Third, adjust height of plunger such that when the plunger is depressed it moves the upper most cartridge in the magazine down enough to create room for another cartridge 405. Fourth, rotate the second member until the plunger is centered over the magazine 407. Fifth, depress plunger and thereby move the upper most cartridge down in the magazine until enough room is created between the depressed round and the uppermost tabs of the magazine 409. Sixth, slide a round into the opening 411. Seventh, release the plunger 413. Eighth, slide the round back further into the magazine until fully seated 415. Repeat the process starting at fifth step until the magazine is full or until the user is done.

Figure 7:
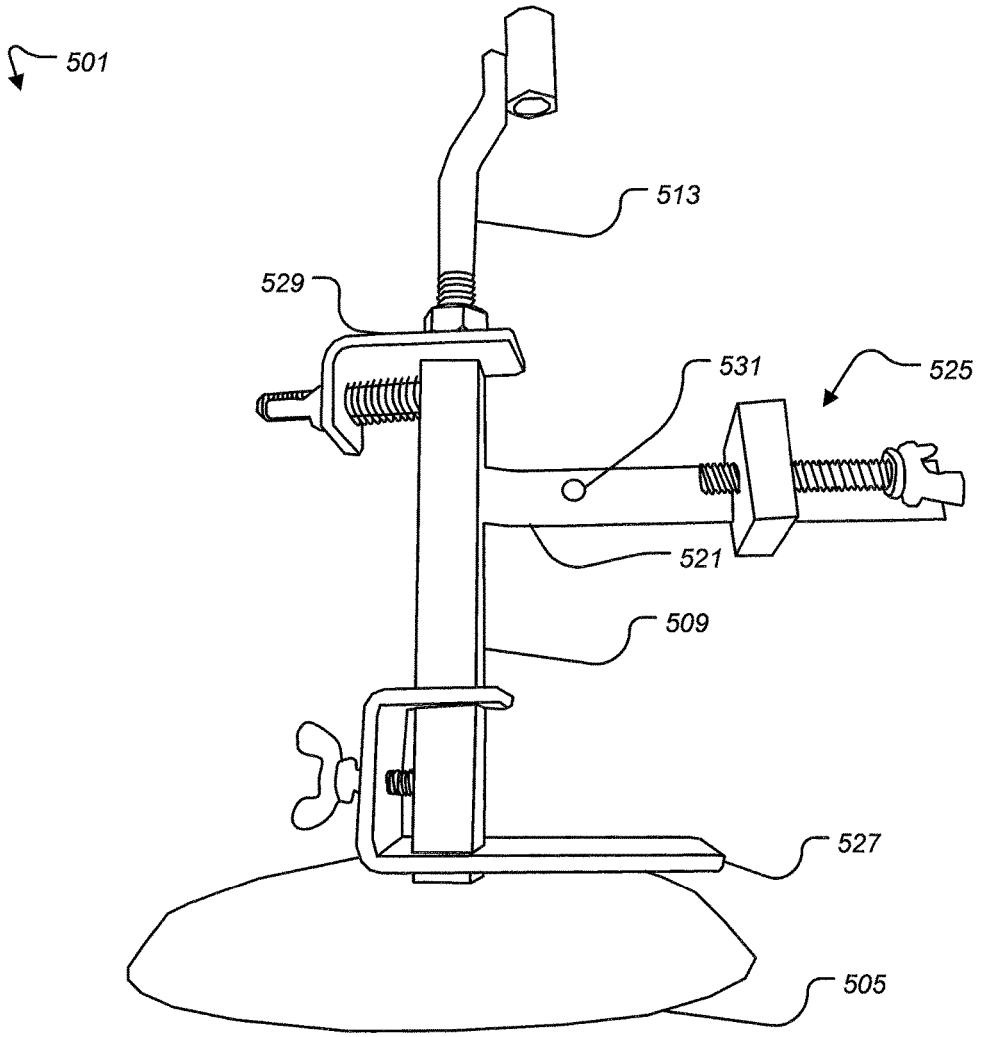
FIG. 7 is a side perspective view of an alternative device for loading ammunition into a magazine according to the present application.
Figure 8:
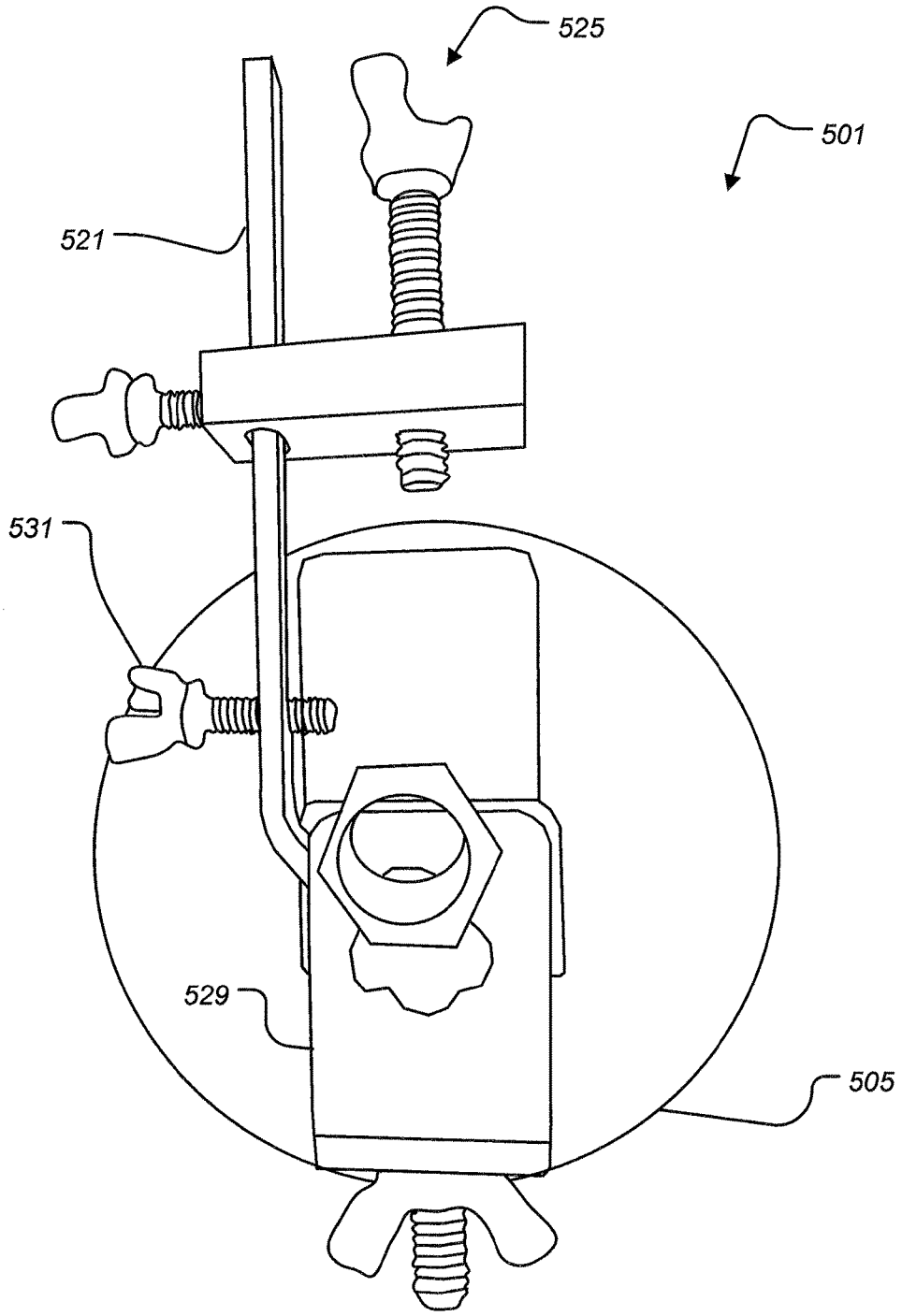
FIG. 8 is a top perspective view of an alternative device for loading ammunition into a magazine according to the present application.
Figure 9:
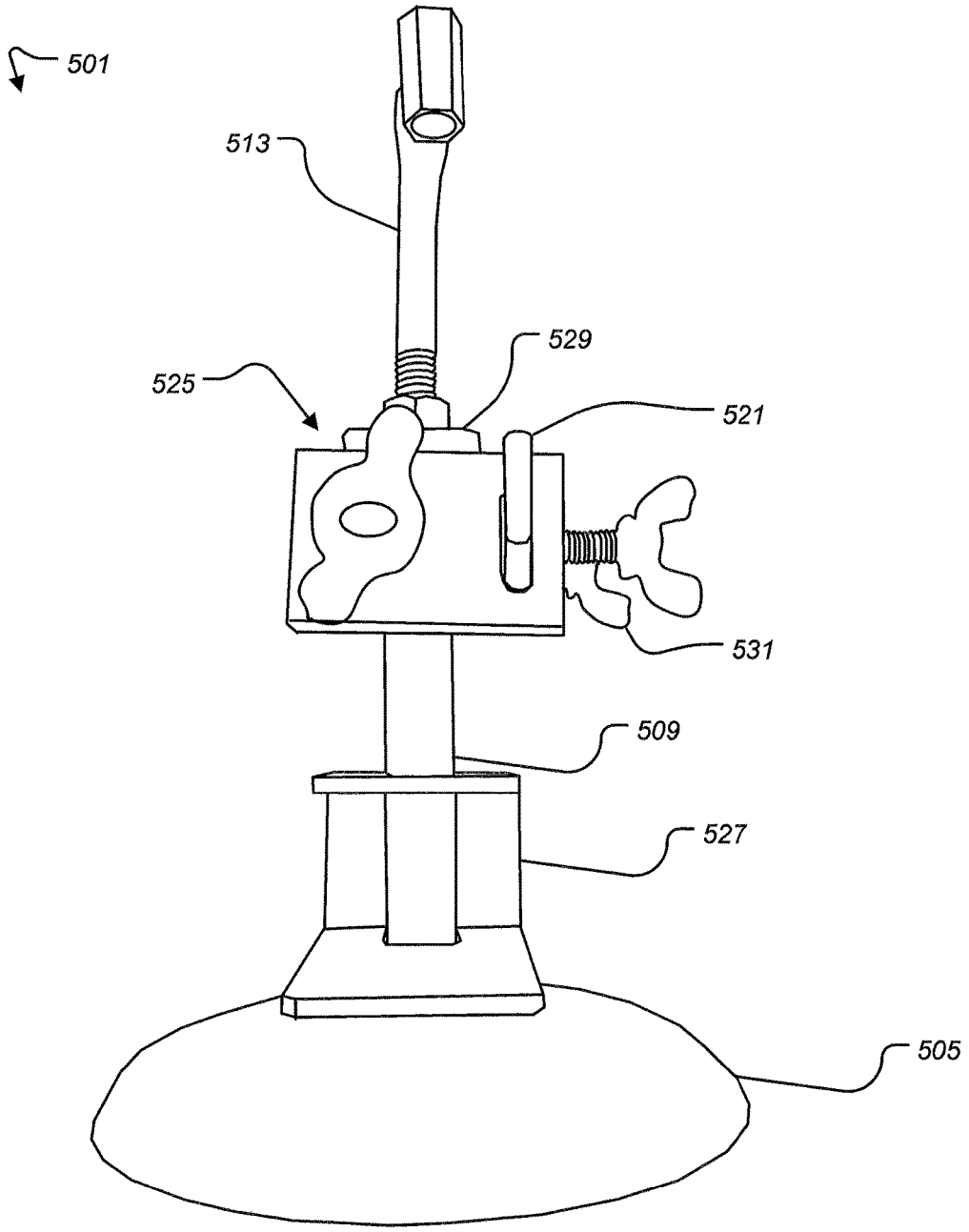
FIG. 9 is an end perspective view of an alternative device for loading ammunition into a magazine according to the present application.

Referring now also to FIGS. 7-9, various views of an alternative device for loading ammunition into a magazine according to the present application is illustrated. Device 501 is comprised of a base 505, a first member 509, a second member 513, a plunger (Not shown), an arm 521, and a first retainment device 525. Device 501 further comprises a second retainment device 527, a third retainment device 529, and a fourth retainment device 531. First retainment device 525 translates along arm 521 to allow the magazine to be coarsely retained and utilizes a threaded member to finely retain the magazine. Second retainment device 527 translates along first member 509, for example to retain the bottom of the magazine. Third retainment device 529 translates between the first member 509 and the second member 513 to contact the magazine. Fourth retainment device 531 is threaded to the arm 521 to contact the magazine. All of the retainment devices are configured to allow the user to position the magazine relative to the lower end of the plunger so that when the plunger is depressed it applies a force onto the most exposed round of ammunition in the magazine and moves the most exposed round of ammunition in the magazine to make room for another round of ammunition to be inserted into the magazine.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An adjustable ammunition loader for a magazine, comprising:

a first member;

a second member having an opening, the second member threadingly retained by the first member at an upper end of the first member, the second member extending from the upper end of the first member generally exterior to the first member;

an arm coupled to the first member configured to secure the magazine adjacent the first member; and a plunger retained by the opening of the second member;

wherein an end of the plunger applies force to a cartridge in the magazine while the plunger is depressed by a user;

wherein the plunger is generally exterior to the second member and completely exterior to the first member.

2. The adjustable ammunition loader for a magazine according to claim 1, further comprising:

a base attached to the first member.

3. The adjustable ammunition loader for a magazine according to claim 1, further comprising:

an adjustable fastener threadingly retained by the arm of the first member.

4. The adjustable ammunition loader for a magazine according to claim 1, further comprising:

a spring located around the plunger for translating the plunger back into a starting position after being depressed by the user.

5. The adjustable ammunition loader for a magazine according to claim 1, further comprising:

a lock washer between the first member and the second member;

wherein the lock washer prevents rotation of the second member relative to the first member.

6. An adjustable ammunition loader for a magazine, comprising:

a first member having;

a base, the first member extending generally upward from the base at a lower end of the first member; and an arm coupled to the first member, the arm extending outward from the first member;

a second member threadingly retained by the first member at an upper end of the first member, the second member extending from the first member and generally exterior to the first member;

a first retainment device supported by the arm of the first member, the first retainment device having a threaded member that secures the magazine adjacent the first member; and a plunger retained by the second member;

wherein the threaded member of the first retainment device supplies a force to a first side of the magazine;

wherein the plunger translates through an opening in the second member; and wherein an end of the plunger applies force to a cartridge in the magazine while the plunger is depressed by a user.

7. The adjustable ammunition loader for a magazine according to claim 6, further comprising:

a second retainment device configured to adjust a height of the magazine relative to the plunger, the second retainment device being supported by the first member and extending from the first member toward the magazine, the second retainment device supporting a lower end of the magazine.

8. The adjustable ammunition loader for a magazine according to claim 7, further comprising:

a third retainment device configured to apply a force on the magazine on a second side of the magazine, the second side being opposite of the first side of the magazine, the third retainment device being supported at the upper end of the first member and extending from the upper end of the first member roughly normal to the first member.

9. The adjustable ammunition loader for a magazine according to claim 8, further comprising:

a fourth retainment device configured to apply a force on a third side of the magazine, the third side being roughly perpendicular to the first side, the fourth retainment device being supported on the arm of the first member and having a threaded member that extends roughly perpendicular to the arm of the first member to supply the force on the third side of the magazine.

10. The adjustable ammunition loader for a magazine according to claim 9, wherein the first retainment device translates along the arm.

11. The adjustable ammunition loader for a magazine according to claim 10, wherein the second retainment device translates along the first member.

12. The adjustable ammunition loader for a magazine according to claim 11, wherein the third retainment device translates generally perpendicular to the first member at the upper end of the first member.

13. The adjustable ammunition loader for a magazine according to claim 11, wherein the threaded member of the fourth retainment device is threaded in the arm.

14. The adjustable ammunition loader for a magazine according to claim 6, further comprising:

a spring located around the plunger for translating the plunger back into a starting position after being depressed by the user.

* * * * *